US006801165B2

(12) United States Patent
Fang

(10) Patent No.: US 6,801,165 B2
(45) Date of Patent: Oct. 5, 2004

(54) MULTI-PATCH ANTENNA WHICH CAN TRANSMIT RADIO SIGNALS WITH TWO FREQUENCIES

(75) Inventor: Chien-Hsing Fang, Taipei Hsien (TW)

(73) Assignee: Wistron NeWeb Corporation (TW)

( * ) Notice: Subject to any disclaimer, the term of this patent is extended or adjusted under 35 U.S.C. 154(b) by 0 days.

(21) Appl. No.: 10/248,921

(22) Filed: Mar. 2, 2003

(65) Prior Publication Data

US 2004/0027285 A1 Feb. 12, 2004

(30) Foreign Application Priority Data

Aug. 9, 2002 (TW) ..... 91118038 A

(51) Int. Cl.[7] ..... H01Q 1/38

(52) U.S. Cl. ..... 343/700 MS; 343/729; 343/770

(58) Field of Search ..... 343/700 MS, 727, 343/725, 729, 767, 770

(56) References Cited

U.S. PATENT DOCUMENTS

| | | | | | |
|---|---|---|---|---|---|
| 4,775,866 | A | | 10/1988 | Shibata et al. | |
| 5,966,101 | A | | 10/1999 | Haub et al. | |
| 6,043,786 | A | | 3/2000 | Vannatta et al. | |
| 6,052,086 | A | * | 4/2000 | Kudoh | 343/700 MS |
| 6,211,824 | B1 | * | 4/2001 | Holden et al. | 343/700 MS |
| 6,492,947 | B2 | * | 12/2002 | Anderson | 343/700 MS |

* cited by examiner

*Primary Examiner*—Shih-Chao Chen
(74) *Attorney, Agent, or Firm*—Winston Hsu

(57) ABSTRACT

A multi-patch antenna that can transmit radio signals with two frequencies includes a PCB and two stacked-patches. The PCB includes a substrate, a metal layer formed on an upper side of the substrate, and a microstrip line formed on a lower side of the substrate for transmitting radio signals to two slots. The radio signals resonate within the two slots and the stacked-patches, and are then emitted from the stacked-patches in a direction normal to the stacked-patches.

20 Claims, 5 Drawing Sheets

MULTI-PATCH ANTENNA WHICH CAN TRANSMIT RADIO SIGNALS WITH TWO FREQUENCIES

BACKGROUND OF INVENTION

1. Field of the Invention

The present invention relates to a multi-patch antenna, and more specifically, to a multi-patch antenna that can provide two frequency service.

2. Description of the Prior Art

The rapid development of the Internet has allowed data and information to accumulate rapidly, and the circulation and sharing of large amounts of technology and knowledge is becoming increasingly efficient. Recently, developments in wireless networks allow users to access network resources whenever and wherever they want. Information is entering every aspect of our work and our lives. One feature of wireless networks is to remove the cables associated with traditional network infrastructure. Using electromagnetic waves or infrared signals to transfer data between network terminals, users can connect to a wireless network and access network resources. Under wireless network system architecture, all network servers transmit and receive wireless data signals via an access point, and provide network resources and service wirelessly. Similarly, in order to utilize the resources and services provided by wireless networks, the connecting terminals need the ability to transmit and receive wireless data signals. Terminals such as PCs or notebook computers can be expanded to have wireless network functions by installing wireless LAN cards.

The service range and area of a wireless network is largely influenced by the design of an access point. The design of an internal antenna in the access point plays a very important part. If a multi-patch structure is used, the antenna can benefit from the effects of high gain and high bandwidth.

Please refer to FIG. 1, which is an exploded perspective view of a prior art multi-patch antenna 10. The multi-patch antenna 10 comprises a stacked-patch 18, a PCB 30, and a feed line 37. The stacked-patch 18 comprises a first substrate 20, a first filling layer 22, a second substrate 24, and a second filling layer 26 in an arrangement that yields an ability to operate using a wide bandwidth. An upper layer of the PCB 30 comprises a ground layer 28. Below the ground layer 28 is a substrate 32, and below the substrate 32 is a microstrip line 34 electronically connected to the feed line 37 for receiving input radio signals at one end. Further provided is a slot 36 in the ground layer 28 directly beneath the stacked-patch 18 and crossing the microstrip line 34. When multi-patch antenna 10 is required to send out a radio signal, the radio signal is input from feed line 37.

The multi-patch antenna 10 is an application of mature technology. Take for example a 2.4 GHz frequency according to IEEE802.11b, a gain of the antenna 10 can reach approximately 6 dBi to 9 dBi, with a bandwidth that is about 15% above average. The same design principle can also be applied to a high gain antenna conforming to a 5.25 GHz band of IEEE 802.11a. Currently, IEEE 802.11 module chip design has led to an intelligent module that can use either the 2.4 GHz or 5.25 GHz frequencies to communicate with IEEE 802.11b or IEEE 802.11a modules at other access points. But under these circumstances, the multi-patch antenna 10 described above is inadequate. The use of microwave bands is becoming increasingly complicated. For instance, the most general IEEE 802.11 standard currently used for wireless networks has the common 2.4 GHz ISM wave band in IEEE 802.11b and an improved version of the 5.25 GHz in IEEE 802.11b. Furthermore, 5.4 GHz~5.8 GHz is now in application in a European standard of HyperLan-2. A key reason why we must develop a antenna with the capability to receive and transmit with multiple frequencies is to reduce access point design complexity and cost.

SUMMARY OF INVENTION

It is therefore a primary objective of the claimed invention to provide a multi-patch antenna with the capability for dual frequency service, fulfilling the need for a single antenna to transmit two frequencies simultaneously.

The multi-patch antenna comprises a PCB and two stacked-patches. The PCB includes a substrate, a metal layer formed on an upper side of the substrate, and a microstrip line formed on a lower side of the substrate. The microstrip line transmits radio signals through two slots above the metal layer, the two slots being covered by the two stacked patches. The radio signals resonate within the two slots and the two stacked patches covering the two slots, and are then emitted from the stacked-patches in a direction normal to the stacked-patches.

It is an advantage that the claimed invention can receive and transmit two frequencies simultaneously.

It is an advantage of the claimed invention that the structure of the multi-patch antenna causes it to be highly unidirectional. It can not only be used in outdoor point-to-point communication, but can also be used indoors as a wall-hanging or ceiling-fastened device. With its high gain and unidirectionality, the claimed invention flat patch antenna design boosts communication quality.

These and other objectives of the claimed invention will no doubt become obvious to those of ordinary skill in the art after reading the following detailed description of the preferred embodiment that is illustrated in the various figures and drawings.

DETAILED DESCRIPTION

Figure 1:
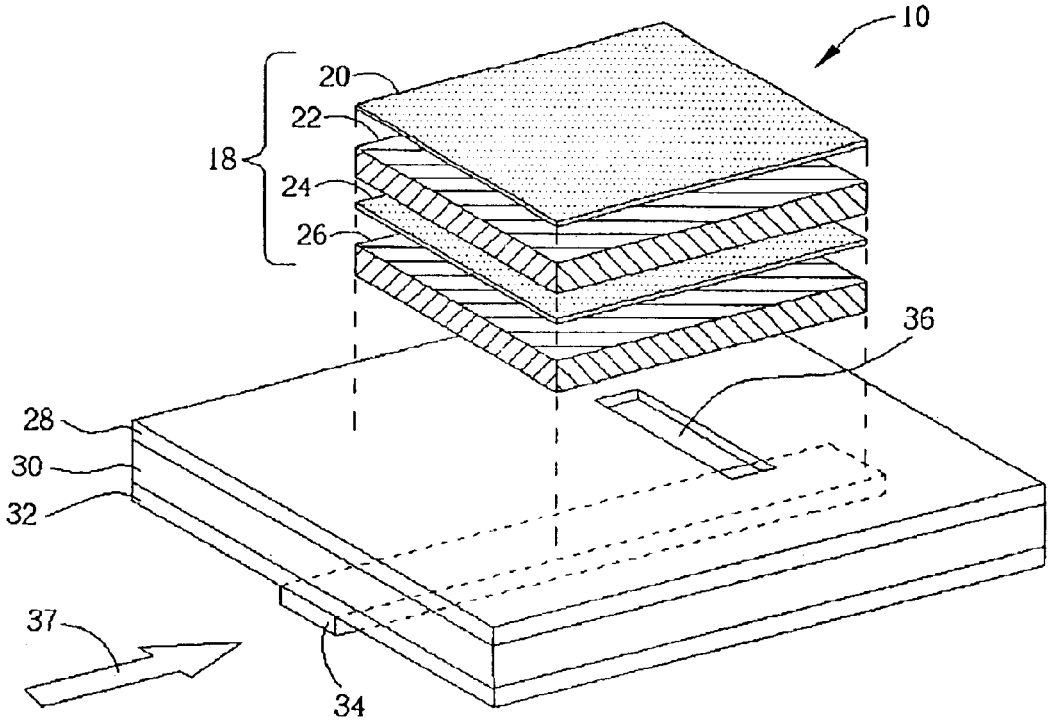
Fig. 1 Prior art
FIG. 1 is an exploded perspective view of a prior art multi-patch antenna.
Figure 2:
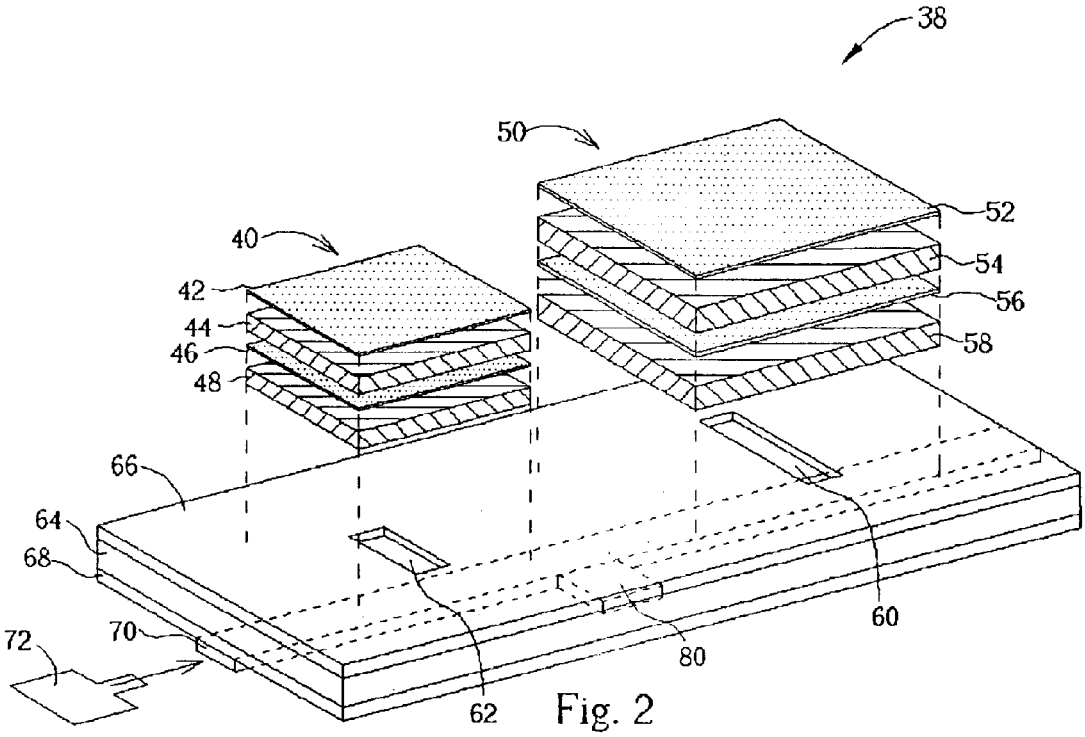
FIG. 2 is an exploded perspective view of a present invention multi-patch antenna.

Please refer to FIG. 2 showing an exploded perspective view of a multi-patch antenna 38 according to the preferred embodiment of the present invention. The multi-patch antenna 38 comprises a first stacked-patch 40, a second stacked-patch 50, a PCB 64, and a feed line 72. The first stacked-patch 40 includes a first A flat patch layer 42, a first A filling layer 44, a second A flat patch layer 46, and a second A filling layer 48. The second stacked-patch 50 includes a first B flat patch layer 52, a first B filling layer 54, a second B flat patch layer 56, and a second B filling layer 58. The first stacked-patch 40 and the second stacked-patch 50 give the present invention multi-patch antenna 38 a wide bandwidth. The upper layer of the PCB 64 comprises a ground layer 66. Below the ground layer 66 is a substrate 68, and below the substrate 68 is a microstrip line 70. The microstrip line 70 is electronically connected to the feed line 72, and receives input radio signals at one end. The ground layer 66 has a first slot 62 located under the first stacked-patch 40, and a second slot 60 located under the second stacked-patch 50. These two slots 62 and 60 sit across the microstrip line 70. A first resonant cavity is formed between the first slot 62 and the first stacked-patch 40. A second resonant cavity is formed between the second slot 60 and the second stacked-patch 50. The first slot 62 is smaller than the second slot 60. Similarly, an area of the first stacked-patch 40 covering the first slot 62 is smaller an area of the second stacked-patch 50 covering second slot 60. The reason for this is that the first resonant cavity is for higher frequency radio wave signals, and the second resonant cavity is for lower frequency radio wave signals. In the preferred embodiment, the radio signal with a higher frequency is on a 5.25 Ghz carrier wave according to the IEEE 802.11a specification, and the radio signal with a lower frequency is on a 2.4 GHz carrier wave according to IEEE 802.11b.

When the multi-patch antenna 38 is required to transmit a dual-frequency radio signal, it first transfers the dual-frequency radio signal into the microstrip line 70 via the feed line 72, and then transfers this signal in the direction of the first slot 62 and the second slot 60. A higher frequency 5.25 GHz component of the radio signal resonates in the first resonant cavity formed by the first slot 62, and is then emitted from the stacked-patch 40 in a direction normal to the first stacked-patch 40. A lower frequency 2.4 GHz component of the radio signal resonates in the second resonant cavity formed by the second slot 60, and is then emitted from the stacked-patch 50 in a direction normal to the second stacked-patch 50.

The present invention dual-frequency antenna 38 uses a single input port and a single feed point to achieve dual bandwidth. Consider the previous examples of 2.4 GHz and 5.25 GHz, using the same feed line to reach different feed points, and using different resonant structures to create different frequency resonance. This concept uses the feed shown in FIG. 2. A signal enters the microstrip antenna, when it passes through the slot 62, higher frequency signals such as 5.25 GHz signals of IEEE 802.11a resonate in the first resonant cavity, while lower frequency signals such as 2.4 GHz signals of IEEE 802.11b resonate in the second resonant cavity. Whether high or low frequency signals resonate with a slot depends on the geometric shape of the slot and the overall structure resistance. In the preferred embodiment, the first slot 62 has a resistance matching a high frequency of 5.25 GHz, and the second slot 60 has a resistance matching a low frequency of 2.4 GHz. The geometric shape of the stacked-patches 40, 50 and the lengths of the first and second slots 62, 60 are adjusted according to the frequencies to resonate, with preferred lengths of the first and second cavities being about $\lambda_{high}/2$ and $\lambda_{low}/2$ respectively.

There is a great difference in the wavelengths of the two radio signals (2.4 GHz and 5.25 GHz) serviced by the antenna 38. The 2.4 GHz signal does not have too much variation to the resistance for this lower frequency radio signal when it passes through first slot 62. Signals still follow the microstrip line shown in FIG. 2 and transfer to the feed point of the second slot 60, and not much reflection loss occurs in the first slot 62 because of resistance mismatch. But in other embodiments, where the dual frequency is very close (that is if the corresponding wavelengths $\lambda_h$ and $\lambda_z$ for two frequencies $f_h$ and $f_z$ are close to each other), the lower frequency radio signal $\lambda_{low}$ will generate reflection when passing slot 62 causing signal attenuation. In order to lower frequency signal transfers in the microstrip line 70 (supposing a resistance of 50 Ω) through slot 62 without reflection, a tuning stub 80 is installed on the microstrip line 70 between first slot 62 and second slot 60. A resistance of the tuning stub 80 is determined by the combination of resistance of slots, servicing frequency, and microstrip line 70. According to this resistance, the corresponding geometric shape and the location of the installation is determined, so that the lower frequency radio signal can use the 50 Ω microstrip line 70 and enter the second slot 60 with a matching resistance. The tuning stub 80 can be an open stub or a grounding short stub. The microstrip line 70 within first slot 62 and second slot 60 can function as transformer.

Figure 3:
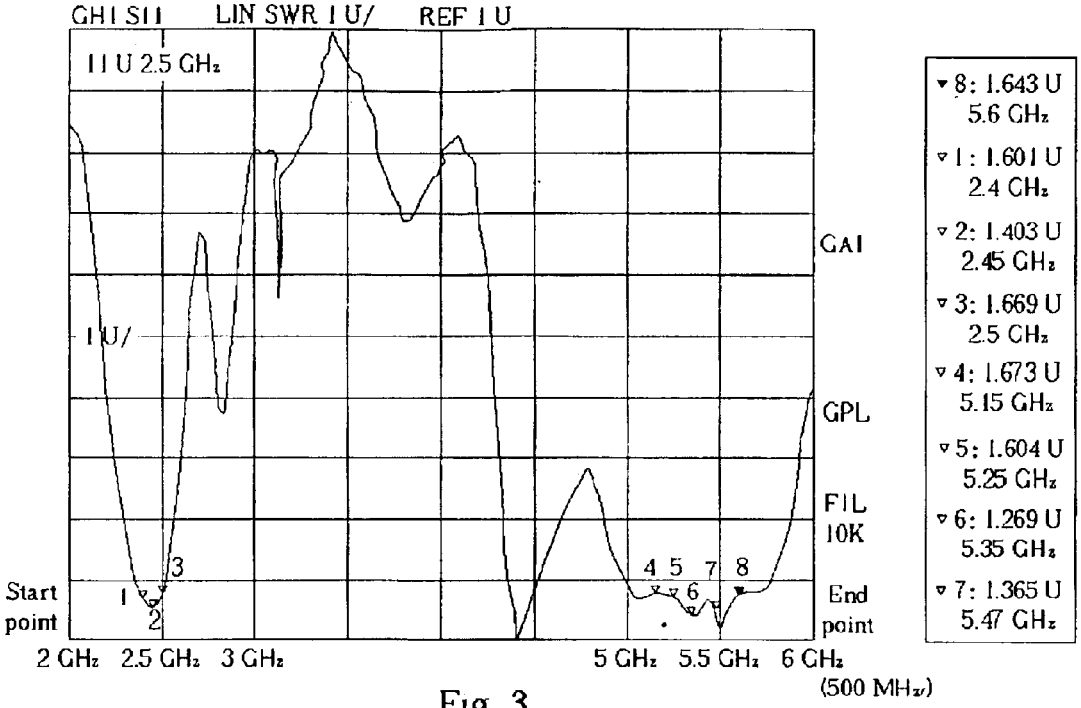
FIG. 3 is a graph of a dual frequency voltage standing wave ratio measured result for the multi-patch antenna of FIG. 2.
Figure 4:
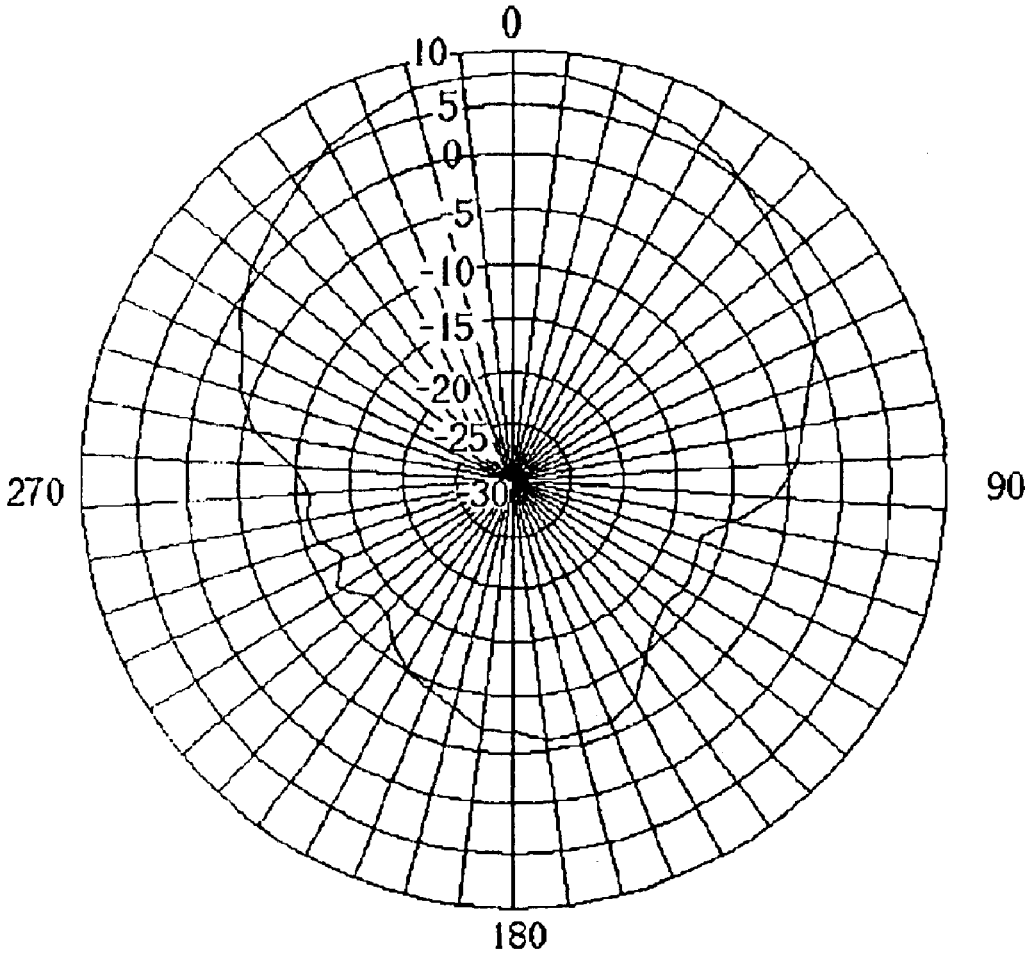
FIG. 4 is an antenna pattern plot for the multi-patch antenna of FIG. 2 at 2.4 GHz.
Figure 5:
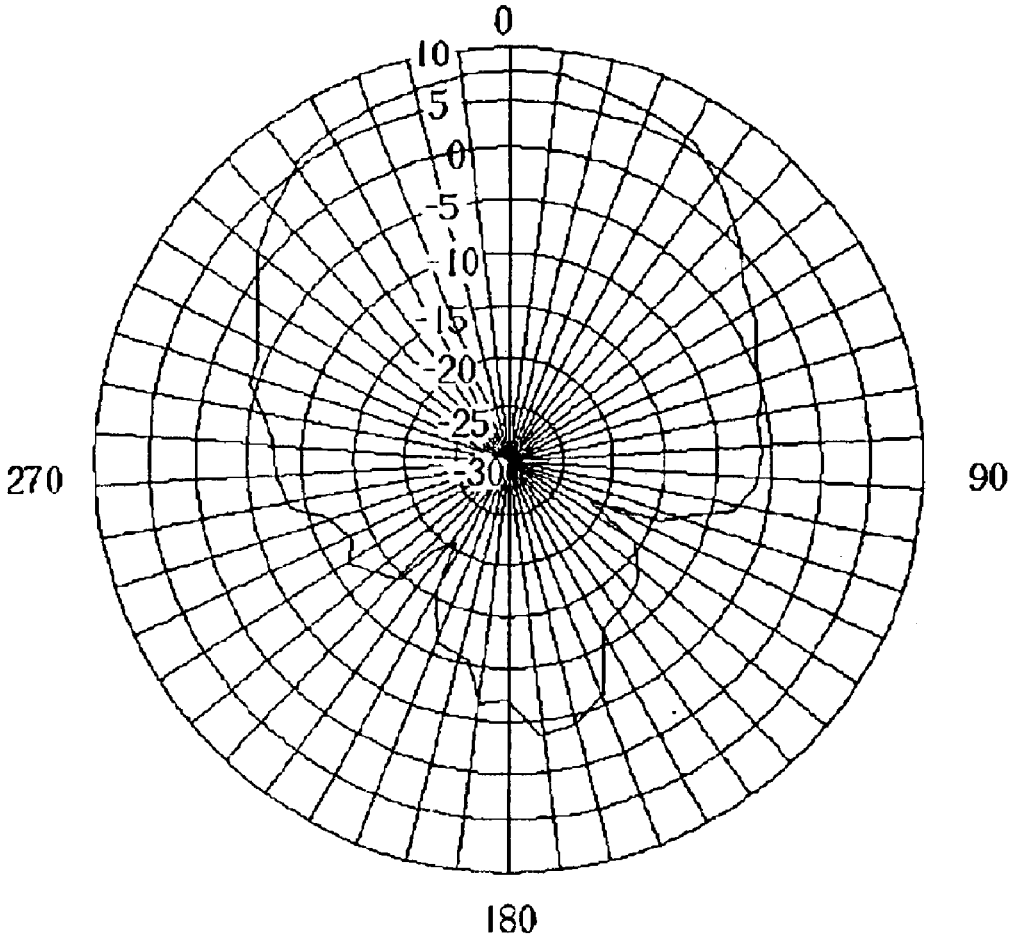
FIG. 5 is an antenna pattern plot for the multi-patch antenna of FIG. 2 at 5.25 GHz.

Please refer to FIG. 3. FIG. 3 is a graph of a dual-frequency voltage standing wave ratio (VSWR) measured result of the present invention multi-patch antenna 38. Please refer to FIG. 4 and FIG. 5. FIG. 4 is an antenna pattern plot for the present invention multi-patch antenna 38 at 2.4 GHz; FIG. 5 is an antenna pattern plot for the present invention multi-patch antenna 38 at 5.25 GHz. FIG. 3 shows the VSWR of a dual frequency signal corresponding to predetermined service under IEEE 802.11b and IEEE 802.11a by the multi-patch antenna 38. The measured result shows that 3 dBi bandwidth of 2.4 GHz and 5.25 GHz can provide over a 15% improvement. According to FIG. 4 and FIG. 5, a dual-frequency pattern gain and antenna gain values of the present invention can reach 60 degrees for a beamwidth of 3 dBi. Hence, the present invention multi-patch antenna 38 is highly unidirectional and capable of high bandwidth and high gain to cover a larger service area. Wireless network products applying the present invention will utilize the features of larger service area coverage and highly unidirectional dual-frequency functionality to fulfill requirements of Internet connections everywhere. The present invention antenna can be installed anywhere, not only in common office environments, but also in general households.

Described above is only the preferred embodiment of the present invention. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A patch antenna comprising:

a PCB comprising:

a substrate;

a metal layer formed on an upper side of the substrate, the metal layer including a first slot and a second slot; and a microstrip line formed on a lower side of the substrate for transmitting radio signals to the first and second slots to resonate;

a first stacked-patch formed above the first slot for making a first resonant cavity with the first slot; and a second stacked-patch formed above the second slot for making a second resonant cavity with the second slot.

2. The patch antenna of claim 1 wherein each of the stacked-patch comprises two parallel patch layers and two filling layers.

3. The patch antenna of claims 1 wherein the first slot is smaller than the second slot, and the first slot is fed a higher frequency of radio signals than the second slot to generate resonance.

4. The patch antenna of claim 3 wherein the first slot is fed radio signals of approximately 5.25 GHz frequency to generate resonance, and the second slot is fed radio signals of approximately 2.4 GHz frequency to generate resonance.

5. The patch antenna of claim 1 wherein the microstrip line is across the two slots.

6. The patch antenna of claim 5 wherein the microstrip line is perpendicular to the two slots.

7. The patch antenna of claim 1 wherein the microstrip line comprises a tuning stub.

8. The patch antenna of claim 1 wherein the radio signals are fed to the microstrip line by a transmission line.

9. The patch antenna of claim 1 wherein the metal layer is connected to ground.

10. A patch antenna comprising:

a substrate;

a metal layer formed on a first side of the substrate, the metal layer including a first slot and a second slot;

a microstrip line crossing the first slot and the second slot on a second side of the substrate for feeding signals to the first slot and the second slot;

a first patch coupling with the first slot for generating a first resonant frequency band of the patch antenna; and a second patch coupling with the second slot for generating a second resonant frequency band of the patch antenna.

11. The patch antenna of claim 10 further comprising a tuning stub installed on the microstrip line.

12. A patch antenna comprising:

a first conductive piece located on a first substrate piece in which a first slot is formed within the first conductive piece, a second conductive piece located on a second substrate piece in which a second slot is formed within the second conductive piece, a microstrip line attached to the first and second substrate pieces for transmitting radio signals to the first and second slots;

a metal layer formed on an upper side of the substrate, the metal layer including a first slot and a second slot that is larger than the first slot; and a first stacked-patch formed above the first slot to constitute a first resonant cavity with the first slot; and a second stacked-patch formed above the second slot to constitute a second resonant cavity with the second slot.

13. The patch antenna of claim 12 wherein the first and second substrate pieces are formed on a single substrate layer and the first and second conductive pieces are formed on a single conductive layer.

14. The patch antenna of claim 13 wherein the microstrip line comprises a tuning stub.

15. The patch antenna of claim 14 wherein the microstrip line is perpendicular to the two slots.

16. The patch antenna of claim 15 wherein each of the first and second stacked-patches comprises two parallel patch layers and two filling layers.

17. The patch antenna of claim 16 wherein the first slot is fed radio signals of approximately 5.25 GHz frequency to generate resonance, and the second slot is fed radio signals of approximately 2.4 GHz frequency to generate resonance.

18. The patch antenna of claim 12 wherein the microstrip line comprises a tuning stub.

19. The patch antenna of claim 18 wherein the tuning stub is disposed between the first slot and the second slot.

20. The patch antenna of claim 19 wherein each of the first and second stacked-patches comprises two parallel patch layers and two filling layers.

* * * * *